US009248646B1

(12) United States Patent
Egan et al.

(10) Patent No.: US 9,248,646 B1
(45) Date of Patent: Feb. 2, 2016

(54) PRINTHEAD FOR GENERATING PRINT AND NON-PRINT DROPS

(71) Applicant: Eastman Kodak Company, Rochester, NY (US)

(72) Inventors: Kevin P. Egan, Tipp City, OH (US); Seth C. Clark, Centerville, OH (US); William H. Sommerville, III, Huber Heights, OH (US); Robert J. Simon, Bellbrook, OH (US); Douglas E. Schultz, Miamisburg, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/706,043

(22) Filed: May 7, 2015

(51) Int. Cl.
*B41J 2/09* (2006.01)
*B41J 2/03* (2006.01)

(52) U.S. Cl.
CPC ..... *B41J 2/09* (2013.01); *B41J 2/03* (2013.01)

(58) Field of Classification Search
CPC ..... B41J 2/03; B41J 2/09; B41J 2002/031; B41J 2002/033; B41J 2202/16
See application file for complete search history.

(56) References Cited

U.S. PATENT DOCUMENTS 6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
6,899,410 B2 * 5/2005 Jeanmaire ..... B41J 2/03 347/21
7,735,980 B2 * 6/2010 Xu ..... B41J 2/02 347/77
8,091,991 B2 * 1/2012 Hanchak ..... B41J 2/09 347/77

* cited by examiner

*Primary Examiner* — Juanita D Jackson
(74) *Attorney, Agent, or Firm* — Nelson A. Blish; William R. Zimmerli

(57) ABSTRACT

A printhead having a drop generator for creating print and non-print drops and a drop deflector for causing the trajectories of the print drops and the non-print drops to diverge includes a liquid extraction channel for removing liquid from the gas flow duct; the liquid extraction channel having an entrance which opens off from the gas flow duct; an outlet; a catcher for collecting the non-print drops wherein the catcher has an ink return channel; at least one via connecting the ink return channel to the liquid extraction channel; and wherein a portion of the liquid passing through the ink return channel of the catcher flows through the at least one via into the liquid extraction channel and from the liquid extraction channel out the outlet.

6 Claims, 8 Drawing Sheets

PRINTHEAD FOR GENERATING PRINT AND NON-PRINT DROPS

FIELD OF THE INVENTION

This invention relates generally to the field of digitally controlled printing devices, and in particular to continuous printing systems in which a liquid stream breaks into droplets that are deflected by a gas flow.

BACKGROUND OF THE INVENTION

Continuous stream inkjet printing uses a pressurized ink source to supply ink to one or more nozzles to produce a continuous stream of ink from each of the nozzles. Stimulation devices, such as heaters positioned around the nozzle, stimulate the streams of ink to break up into drops with either relatively large volumes or relatively small volumes. These drops are then directed by one of several systems including, for example, electrostatic deflection or gas flow deflection devices.

In printheads that include gas flow deflection systems, the drop deflecting gas flow is produced at least in part by a gas, typically air, drawn laterally across the drop trajectories into a negative gas flow duct as a result of vacuum applied to the duct. Drops of a predetermined small volume are deflected more than drops of a predetermined large volume. This allows for the small drops to be deflected into an ink capturing mechanism (catcher, interceptor, gutter, etc.) where they are either recycled or discarded. The large drops are allowed to strike the print medium. Alternatively, the small drops may be allowed to strike the print medium while the larger drops are collected in the ink capturing mechanism.

It has been determined that while small drops are deflected by the lateral airflow more than large drops, not all small drops follow the same trajectory. Some of these drops can be deflected sufficiently by the air flow such that they enter the gas flow duct, causing ink puddles to form. Ink puddles in the gas flow duct can also be formed during startup and shutdown of the printhead, caused by ink dripping off the upper wall of the gas flow duct and landing on the lower wall of the gas flow duct. Additionally, ink puddles can be formed due to a crooked jet which causes ink to be directed into the gas flow duct. Ink from the puddles of ink in the gas flow duct can be dragged by the gas flow up into the vacuum source that is attached to the gas flow duct, possibly damaging the vacuum source. If the ink puddles remain close to the entrance to the duct, these puddles can affect the uniformity of the air flow across the width of the jet array. Ink puddles can induce oscillations in the gas flow that can produce a modulation in the print drop trajectories that adversely affect print quality.

U.S. Pat. No. 8,091,991 (Hanchak et al.) described a drain for removing such ink from the negative gas flow duct and also a method for cleaning the negative gas flow duct. While the drain is effective at removing such ink from the negative gas flow duct, it has been found that under some conditions the amount of ink that enters the negative gas flow duct and is extracted through the drain can be quite low. Under such conditions some of the ink extracted through the drain can dry in the drain line before reaching the ink reservoir or waste tank. Eventually sufficient ink can dry in the drain line that it begins to clog the drain line. When this occurs ink can begin to build up in the negative gas flow duct, with the problems discussed above.

Accordingly, a need exists to improve the removal of such ink deposits from the interior of the negative gas flow duct of the printhead.

SUMMARY OF THE INVENTION

Briefly, according to one aspect of the present invention a printhead having a drop generator for creating print and non-print drops and a drop deflector for causing the trajectories of the print drops and the non-print drops to diverge includes a liquid extraction channel for removing liquid from the gas flow duct; the liquid extraction channel having an entrance which opens off from the gas flow duct; an outlet; a catcher for collecting the non-print drops wherein the catcher has an ink return channel; at least one via connecting the ink return channel to the liquid extraction channel; and wherein a portion of the liquid passing through the ink return channel of the catcher flows through the at least one via into the liquid extraction channel and from the liquid extraction channel out the outlet.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
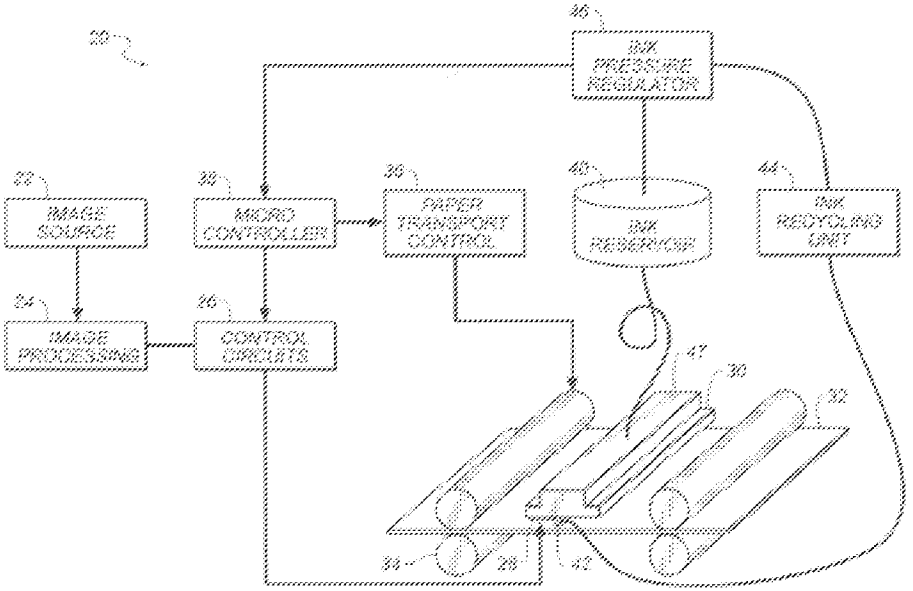
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to bitmap image data by an image processing unit 24 which also stores the image data in memory. A plurality of drop forming mechanism control circuits 26 read data from the image memory and apply time-varying electrical pulses to a drop forming device(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. When the image data does not call for printing a drop on the recording medium, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1), which is described in more detail below with reference to FIGS. 2 and 3.

Figure 2:
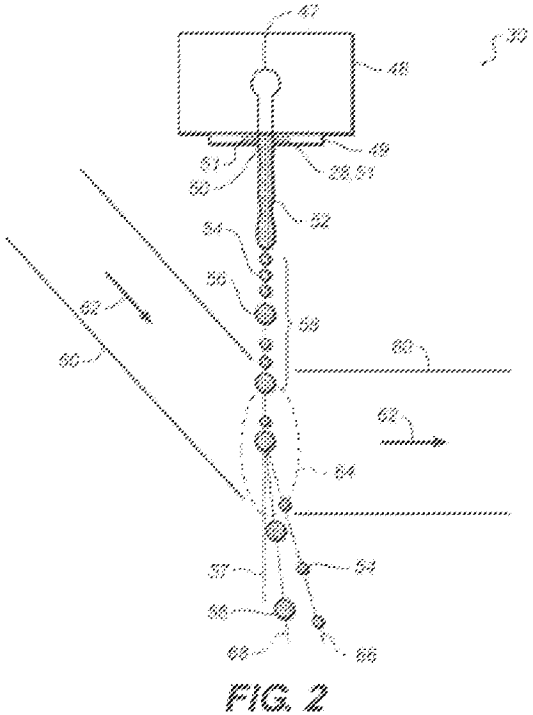
FIG. 2 is a schematic view of an example embodiment of a continuous printhead made in accordance with the present invention.
Figure 3:
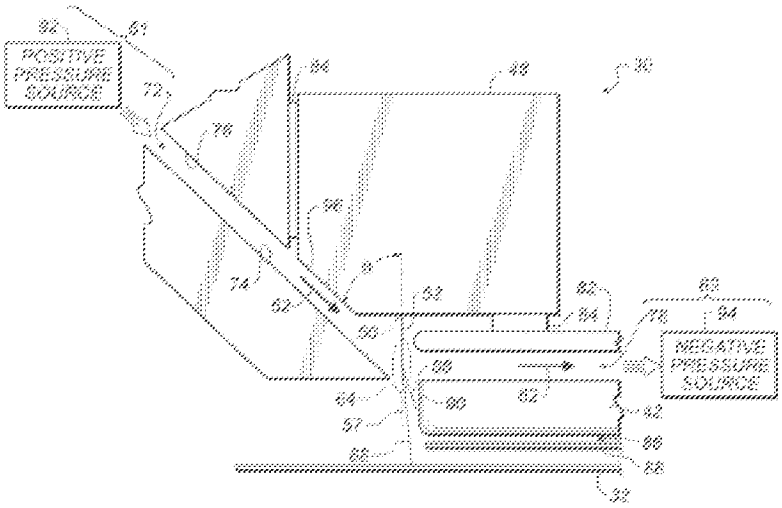
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIGS. 2-5, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to break off from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.).

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64, it alters the drop trajectories. As the drop trajectories pass out of the deflection zone 64, they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes positive gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an gas seal between jetting module 48 and upper wall 76 of positive gas flow duct 72.

Upper wall 76 of positive gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a negative gas flow duct 78 located between catcher 42 and an upper wall 82 that exhausts gas flow from deflection zone 64. The negative gas flow duct 78 is connected to a negative pressure source 94 that is used to help remove gas flowing through second duct 78. An optional seal(s) 84 provides an gas seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by positive gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Figure 4:
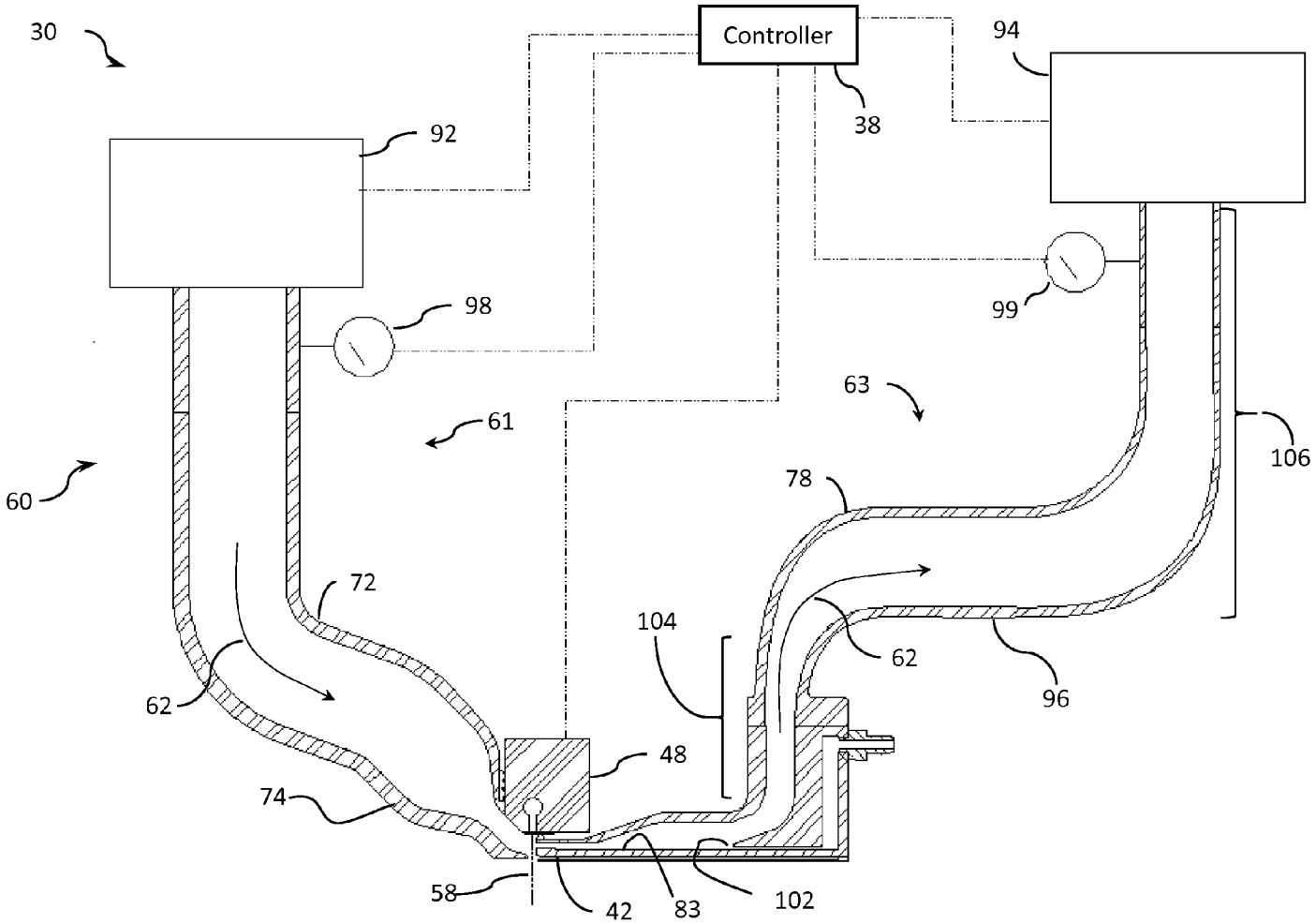
FIG. 4 is a schematic cross-sectional view of a continuous inkjet printhead, showing the gas flow ducts.
Figure 5:
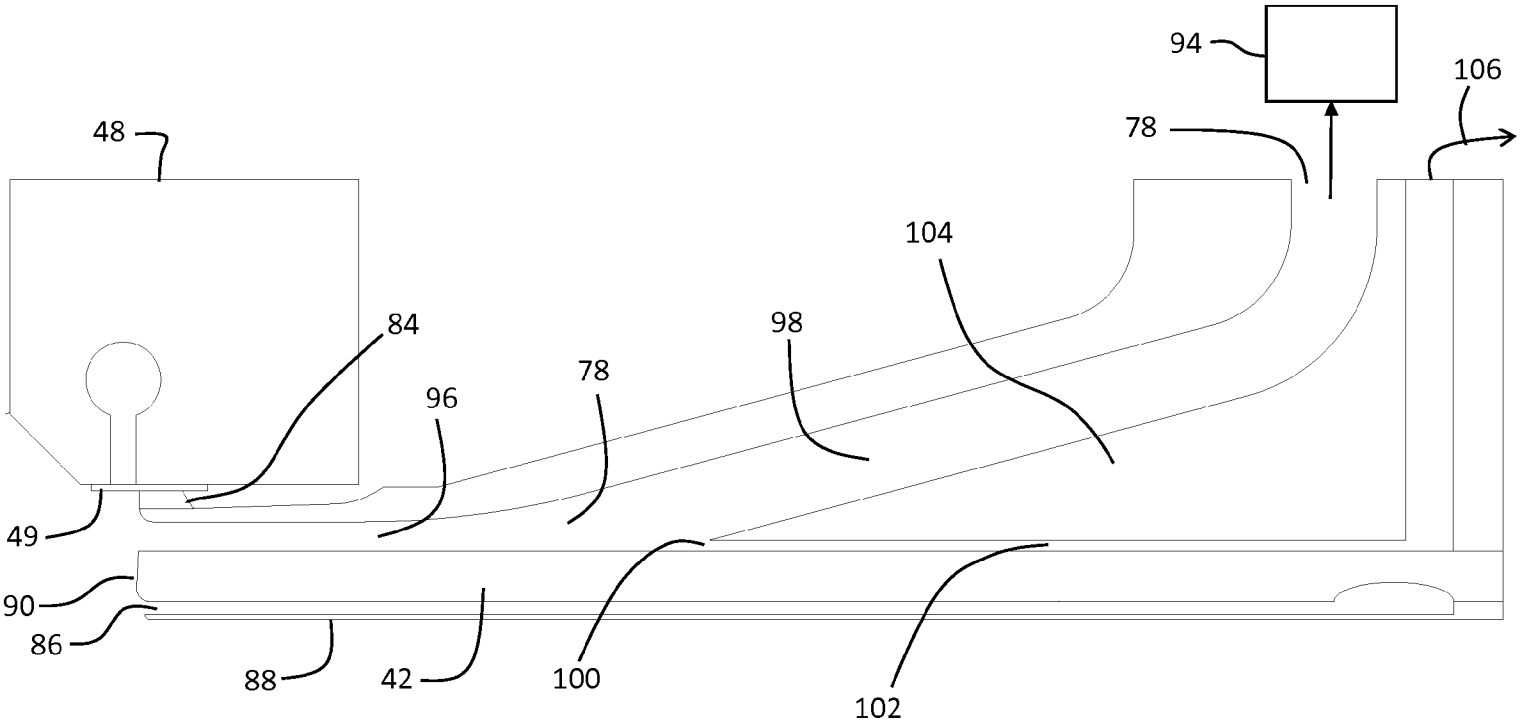
Prior Art FIG. 5
FIG. 5 is a prior art schematic cross-sectional view of a continuous inkjet printhead, showing a portion of the negative gas flow duct and a prior art liquid extraction channel.

FIG. 4 provides a broader cross section view of a printhead 30 than that of FIG. 3 to show more of the gas flow ducts. From the plurality of nozzles of the jetting module 48, streams of drops 58 are created. A gas flow deflection mechanism 60 made up of a positive pressure gas flow structure 61 and a negative pressure gas flow structure 63 directs a flow of gas across the trajectories of the drop streams 58. The positive pressure gas flow structure 61 includes a positive pressure source 92 that produces a flow of gas through the positive gas flow duct 72, directed toward the trajectories of the drop streams. The positive pressure gas flow structure 61 can also include a first gas flow meter 98 to monitor the flow rate of the supplied gas flow. The negative gas flow structure 63 includes a negative pressure source 94 that draws a flow of gas through the negative gas flow duct 78. A second gas flow meter 99 can be included to monitor the flow rate of the gas through the negative gas flow duct 78. The micro-controller 38 can make use of the output from the first and second gas flow meters 98, 99 as feedback in its control of the positive and negative pressure sources 92, 94.

Under some conditions, ink can enter the negative gas flow duct 78. This can occur during one or more of the startup sequence steps, as well as during the printing process. U.S. Pat. No. 8,091,991 disclosed the use of a liquid extraction channel for extracting such ink from the negative gas flow duct. In an embodiment of that invention, shown in FIG. 5, the negative gas flow duct 78 changes direction between a first portion 96 and a second portion 98 of the duct. The entrance 100 of the liquid extraction channel 102 is located along the lower wall 83 of the negative gas flow duct at the transition between the first portion 96 and the second portion 98. The liquid extraction channel 102 can be fabricated in the wall of the duct at the seam between the catcher and the structure 104 that forms the upward sloping lower wall of the negative gas flow duct 78. Ink that strikes the lower wall of the negative gas flow duct 78 is entrained by the gas flow through the duct until it reaches the entrance of the liquid extraction channel. Vacuum applied to the outlet of the liquid extraction channel via a drain line 106 can then pull the ink through the liquid extraction channel. The ink extracted in this manner can be returned through the drain line 106 to the ink reservoir 40 (FIG. 1) or directed to a waste tank (not shown).

It has been found that during normal operation the amount of ink entering the negative gas flow duct and extracted in this manner can be quite low. At such low flow rates of ink through the drain line 106, ink can dry in the drain line 106. Over time sufficient ink can dry in the drain line to obstruct the drain line. If the drain line becomes obstructed then ink that enters the negative gas flow duct can begin to build up in the negative gas flow duct 78, which can lead to a printhead failure.

Figure 6:
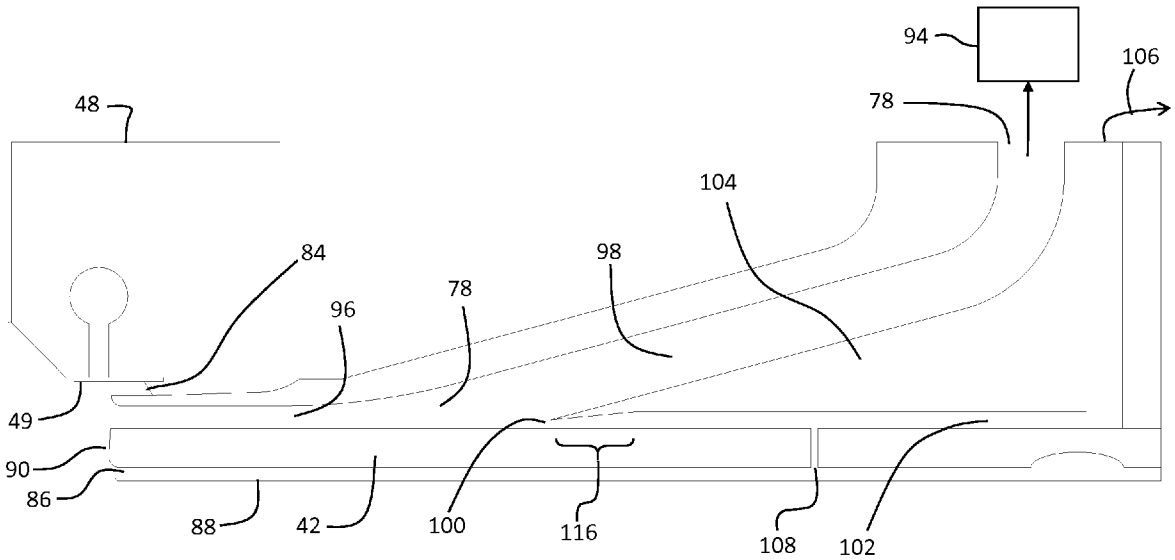
FIG. 6 is a schematic cross-sectional view of a continuous inkjet printhead, showing a portion of the negative gas flow duct, the liquid extraction channel and the liquid return duct of the catcher, made in accordance with the present invention.
Figure 7:
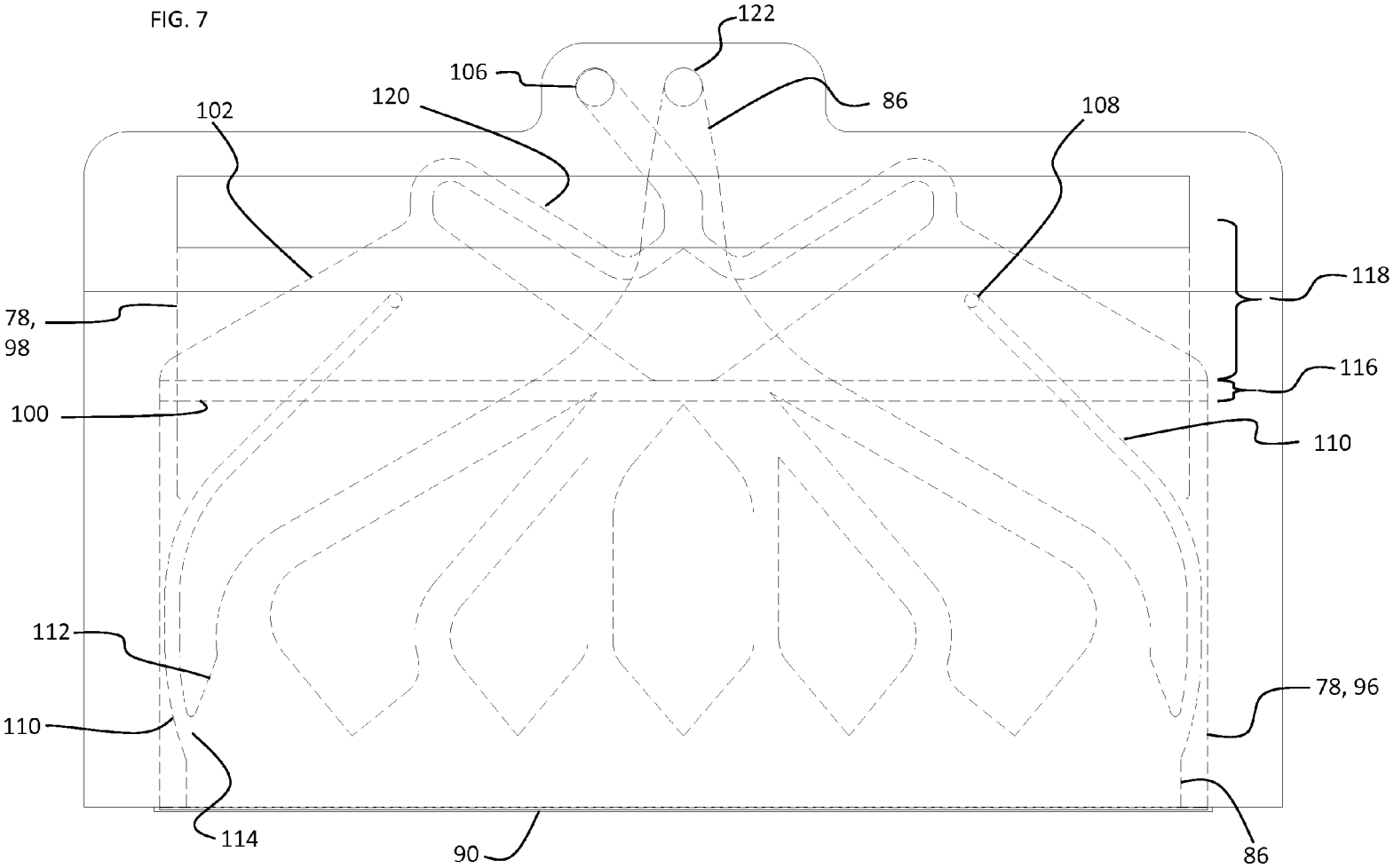
FIG. 7 is a schematic top section view of a continuous inkjet printhead, showing the negative gas flow duct, the liquid extraction channel and the liquid return duct of the catcher, made in accordance with the present invention.
Figure 8:
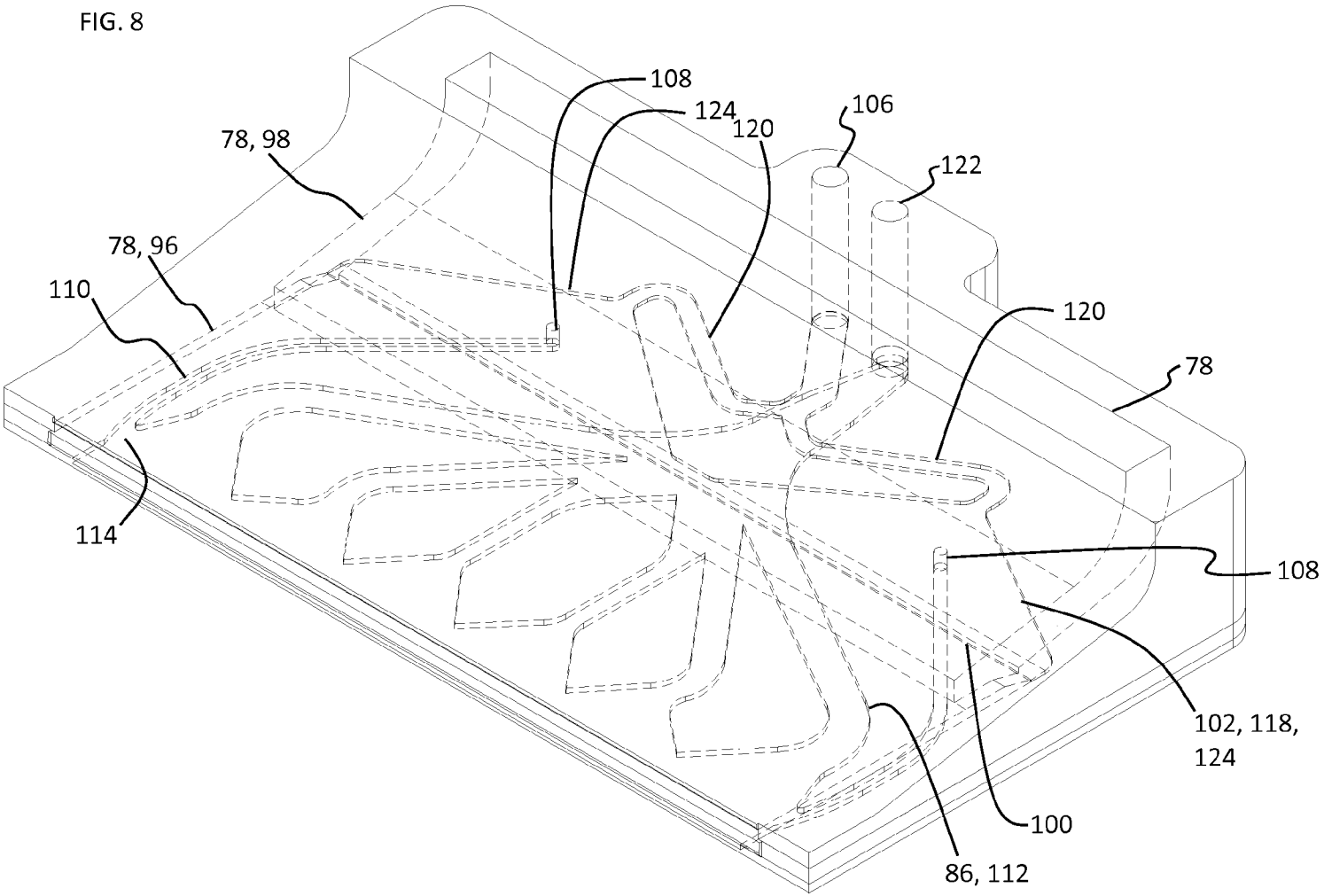
FIG. 8 is a schematic isometric view of a continuous inkjet printhead, showing the negative gas flow, the liquid extraction channel and the liquid return duct of the catcher, made in accordance with the present invention.

The invention prevents the drying of ink in the drain line 106 by providing sufficient flow of ink through the drain line to prevent drying. Ink is obtained for this purpose from the liquid return duct 86 of the catcher. One or more vias 108 are formed through the catcher 42 to provide fluid communication between the liquid return duct 86 of the catcher 42 and the liquid extraction channel 102 of the negative gas flow duct 78, as shown in FIG. 6-8. During normal operation of the printer, the liquid return duct 86 of the catcher is essentially filled with ink from the non-print drop caught by the catcher. The vacuum provided to the liquid extraction channel 102 by means of the drain line 106 is sufficient to suck from some ink through the one or more via 108 from the liquid return duct 86 into the liquid extraction channel 102. The flow of ink into the liquid extraction channel 102 is sufficient to keep ink from drying in the drain line 106, but is not so much that it interferes with the extraction of ink from the negative gas flow duct 78.

In a preferred embodiment, the liquid return duct 86 of the catcher includes at least one small flow channel 110 that branches off from an outer one of the primary flow channels 112 of the liquid return duct and that connects with a via 108. The small flow channel 110 branches off from the primary flow channel at a branching point 114, which is located in the distance range of 0.1 inch to 1 inch from the entrance to the liquid return duct. More preferably the branching point 114 is in the distance range of 0.3-0.7 inches from the entrance to the liquid return duct. It has been found that branching off from the primary flow channel at too large a distance from the entrance can result in the vacuum of the catcher return line applying excessive vacuum to the small flow channel and the via, which inhibits the flow of ink through the via from the liquid return duct of the catcher to the liquid extraction channel of the negative gas flow duct. Placing the branching off point 114 of the small flow channel 110 too close to the entrance of the liquid return duct 86 can result in drawing excessive amounts of air through the vias 108.

Preferably the entrance region of the liquid extraction channel includes an expansion region 116 in which the thickness of the liquid extraction channel increases. see FIG. 6. The increased height of the liquid extraction channel reduces the flow impedance of the liquid extraction channel, and reduces the capillary forces that can retain ink in the liquid extraction channel. The reduced height of the liquid extraction channel 102 right at the entrance 100 provides an increased pressure drop at the entrance to the liquid extraction channel. This increased pressure drop at the entrance reduces the relative flow impedance variations across the width of the liquid extraction channel to improve the uniformity of ink extraction across the liquid extraction channel. The increased pressure drop at the entrance 100 to the liquid extraction channel 102 also helps to provide sufficient vacuum at the vias 108 to draw ink through the vias into the liquid extraction channel. Downstream of the expansion region, the liquid extraction channel includes a funnel region 118 in which the liquid extraction channel, as viewed from the top in FIG. 8, converges into two funnels 124. The funnels 124 funnel the liquid and gas flow in the liquid extraction channel toward two approximately uniform cross-sectional channels 120. The two channels 120 converge to direct the flow to the drain line 106. Preferably the flow impedance of each of the two uniform cross-sectional channels 120 are matched to each other to ensure uniform ink extraction across the width of the liquid extraction channel 102. It has been found that having the funnel region converge to two uniform cross sectional channels instead of a single outlet channel produces more uniform ink extraction across the width of the liquid extraction channel and the width of the negative gas flow duct 78. This reduces the risk of ink getting trapped in low flow regions of the liquid extraction channel.

Preferably the exit of the vias 108 is located near the midpoint of the funnel region 118 between the entrance 100 of the liquid extraction channel and the uniform cross-sectional channels 120. Placement of the vias too far to the rear of the funnel region 118 can limit how much of the liquid extraction channel can be moistened by the flow of ink from the vias, and it can also result in in a higher vacuum level at the vias contributing to an excessive flow of ink through the vias 108 from the catcher liquid return duct. Placement of the via 108 too close to the entrance of the liquid extraction channel can result in too low of a vacuum level at the via which can produce insufficient flow of ink through the vias.

Preferably the vias 108 each have a diameter of approximately 1.6 mm. To small of via can increase the risk that the vias could get clogged with ink, and too large of a via diameter can result in excessive flow of ink into the liquid extraction channel. The via can be formed through the catcher 42 normal to the surface of the catcher 42, or it can be formed at an angle which reduces the flow energy losses as the fluid flow makes the turn from the small channel 110 into the via 108.

U.S. Pat. No. 8,091,991 described a process for cleaning of the negative gas flow duct in which a cleaning liquid is pumped to the negative gas flow duct 78 through the drain line 106. The same cleaning process can be employed with the present invention during shutdown or special cleaning operations of the printing system. Cleaning liquid pumped into the liquid extraction channel 102 through the duct drain 106 can flow out the entrance 100 of the liquid extraction channel into the negative gas flow duct 78. It can then flow out of the negative gas flow duct 78, down the front face 90 of the catcher 42, and into the liquid return duct 86 of the catcher from which it is extracted by vacuum applied to the outlet 122 of the liquid return duct 86. Some of the supplied cleaning liquid can flow directly from the liquid extraction channel 102 to the liquid return duct 86 of the catcher through the vias 108 to help clean the vias and the small flow channels 110 of the catcher.

The invention has been described in detail with particular reference to certain preferred embodiments thereof, but it will be understood that variations and modifications can be effected within the spirit and scope of the invention.

PARTS LIST

20 continuous printer system
22 image source
24 image processing unit
26 mechanism control circuits
28 drop forming device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 positive gas flow duct
74 lower wall
76 upper wall
78 negative gas flow duct

82 upper wall
83 lower wall
84 seal
86 liquid return duct
88 plate
90 front face
92 positive pressure source
94 negative pressure source
96 wall
98 first gas flow meter
99 second gas flow meter
100 entrance
102 liquid extraction channel
104 structure
106 drain line
108 via
110 small flow channel
112 primary flow channel
114 branching point
116 expansion region
118 funnel region
120 uniform cross-sectional channels
122 outlet
124 funnel

The invention claimed is:

1. A printhead having a drop generator for creating print and non-print drops and a drop deflector for causing the trajectories of the print drops and the non-print drops to diverge comprising:

a liquid extraction channel for removing liquid from a gas flow duct;

the liquid extraction channel having an entrance which opens off from the gas flow duct;

an outlet;

a catcher for collecting the non-print drops wherein the catcher has an ink return channel;

at least one via connecting the ink return channel to the liquid extraction channel; and wherein a portion of the liquid passing through the ink return channel of the catcher flows through the at least one via into the liquid extraction channel and from the liquid extraction channel out the outlet.

2. The printhead of claim 1 wherein the entrance has a reduced channel height compared to non-entrance portion of the liquid extraction channel.

3. The printhead of claim 1 wherein the liquid extraction channel funnels into two funnels.

4. The printhead of claim 1 wherein the via connects to a small flow channel that branches off from the liquid return channel of the catcher.

5. A printhead having a drop generator for creating print and non-print drops and a drop deflection mechanism for causing the trajectories of the print drops and the non-print drops to diverge comprising:

a liquid extraction channel for removing liquid from a gas flow duct wherein the liquid extraction channel has an entrance which opens off from the gas flow duct;

an outlet from the liquid extractor channel;

a catcher for collecting the non-print drops wherein the catcher having an ink return channel; and wherein the liquid extraction channel funnels into two funnels.

6. The printhead of claim 5 wherein the entrance has reduced channel height compared to non-entrance portion of the liquid extraction channel.

* * * * *